US007552553B2

(12) United States Patent
Kelly

(10) Patent No.: US 7,552,553 B2
(45) Date of Patent: Jun. 30, 2009

(54) ADVERTISING/PROMOTIONAL DISPLAY AND GIFT DELIVERY SYSTEM

(75) Inventor: Charles Robert Kelly, Wilmington, DE (US)

(73) Assignee: Structural Graphics, LLC, Essex, CT (US)

( * ) Notice: Subject to any disclaimer, the term of this patent is extended or adjusted under 35 U.S.C. 154(b) by 0 days.

(21) Appl. No.: 11/893,087

(22) Filed: Aug. 14, 2007

(65) Prior Publication Data

US 2008/0047175 A1 Feb. 28, 2008

Related U.S. Application Data

(60) Provisional application No. 60/840,228, filed on Aug. 25, 2006.

(51) Int. Cl.
*G09F 1/08* (2006.01)

(52) U.S. Cl. ..... 40/124.08; 40/491; 446/151; 446/486

(58) Field of Classification Search ..... 40/124.01, 40/539, 491, 488, 649, 651, 652, 124.08; 446/308–311, 487, 488
See application file for complete search history.

(56) References Cited

U.S. PATENT DOCUMENTS 3,035,363 A * 5/1962 Luchsinger ..... 40/124.08
5,055,084 A * 10/1991 Jokic ..... 446/486
5,778,578 A * 7/1998 Drapcho et al. ..... 40/491

* cited by examiner

*Primary Examiner*—Paul N Dickson
*Assistant Examiner*—Shin Kim
(74) *Attorney, Agent, or Firm*—Melvin I. Stoltz

(57) ABSTRACT

By providing a unique, pre-printed promotional/delivery system which can be produced in a wide variety of alternate forms and/or configurations incorporating at least two principal cooperating components mounted to each other, with one component being movable relative to a fixed holding component in response to action taken by the user, a unique, hands-on, printed, visually exciting and interest generating advertising/promotional product and/or delivery system is attained. In the preferred construction, the user action causes the movable component to move from a first position, wherein the movable component is fully retained in the holding component, to a second position, wherein the movable component extends outwardly from the holding component. In this way, a unique, user controlled, unanticipated and surprising result is achieved which enables any desired gift, display, award, certificate, prize, or promotion to be delivered in a unique manner.

18 Claims, 4 Drawing Sheets

ADVERTISING/PROMOTIONAL DISPLAY AND GIFT DELIVERY SYSTEM

RELATED DATA

This application is related to U.S. Provisional Patent Application Ser. No. 60/840,228, filed Aug. 25, 2006 entitled ADVERTISING/PROMOTIONAL DISPLAY AND GIFT DELIVERY SYSTEM.

TECHNICAL FIELD

This invention relates to advertising/promotional display systems and, more particularly, to advertising/promotional display systems for providing visually exciting and interest generating products and delivery systems.

BACKGROUND ART

With the ever-increasing quantity of products and services being offered to consumers, substantial interest has been given to promotional systems for advertising such products and services and for presenting gifts or awards to consumers or customers in a unique manner. In this regard, a wide variety of advertising displays and promotional literature has been created and distributed to consumers. However, due to the deluge of material to which average consumers are constantly exposed, greater emphasis has been placed on developing eye-catching visual displays, promotional material, and delivery systems which stand out as being visually unique in order to receive consumer attention.

Although various novelty products, printed displays, and delivery systems have been created in an attempt to satisfy this demand, these prior art products have failed to provide the desired interest generating result with production costs which advertisers are capable of justifying. In attempting to generate a unique advertising display and delivery system, some prior art products have employed complex folding systems which produce a three-dimensional display when activated or unfolded.

In spite of the unique visual appearance generated by such products, the overall cost of production and complexity of the assembly of these systems has prevented such prior art systems from becoming popular. In particular, many prior art systems require multi-part segments to be aligned or placed in specific registered positions or locations. This requirement is both time consuming and costly.

Other prior art displays have attempted to generate consumer interest by providing unique visual images or other indicia as an integral part of the display or delivery system. However, these prior art attempts have also failed to generate the consumer interest being sought, largely due to an inability to physically involve the consumer in the promotion or display operation.

Furthermore, the ever increasing consumer demand seeks to obtain promotional products or delivery systems which produce unique and/or surprising results. In this regard, consumers are continuously seeking products which will produce a surprising visual and/or audible effect when used.

Therefore, it is a principal object of the present invention to provide a printed advertising or promotional product and/or delivery system which is capable of being produced at a reasonable cost and provides an exciting, interest generating display.

Another object of the present invention is to provide a printed advertising or promotional product and/or delivery system having the characteristic features described above, which enables the consumer to physically control the presentation of the display in a unique, hands-on manner.

Another object of the present invention is to provide a printed advertising or promotional product and/or delivery system having the characteristic features described above, which is capable of mass production and assembly.

Another object of the present invention is to provide a printed advertising or promotional product and/or delivery system having the characteristic features described above, which is completely produced and assembled without requiring special segment alignment or registration.

A further object in the present invention is to provide a printed advertising or promotional product and/or delivery system having the characteristic features described above, which provides a unique, eye-catching, exciting and surprising visual change and/or an audible sound generation which is produced in response to action taken by the consumer.

Other and more specific objects will in part be obvious and will in part appear hereinafter.

SUMMARY OF THE INVENTION

By employing the present invention, all of the difficulties and inabilities of the prior art are eliminated and a unique, hands-on, printed, visually exciting and interest generating advertising/promotional product and/or delivery system is attained. This desirable and previously unobtainable result is realized in the present invention by providing a unique, preprinted promotional/delivery system which can be produced in a wide variety of alternate forms and/or configurations.

Regardless of the printed form or configuration desired, the promotional/delivery system of the present invention employs at least two principal cooperating components mounted to each other, with one component being movable relative to a fixed holding component in response to action taken by the user. This user action causes the movable component to move from a first position, wherein the movable component is fully retained in the holding component, to a second position, wherein the movable component extends outwardly from the holding component. In this way, a unique, user controlled, unanticipated and surprising result is achieved which enables any desired gift, display, award, certificate, prize, or promotion to be delivered in a unique manner.

In the principal, preferred construction of the present invention, the promotional/delivery system comprises a holding component which is constructed in the form of a housing having a front wall, a rear wall, and three side edges. The fourth side edge preferably remains open. In addition, one wall member of the housing incorporates a panel mounted on the inside surface thereof which is constructed for providing a ledge at the bottom of the panel which extends into the interior of the housing from the surface of the wall member. In addition, the panel also comprises a finger or tab formed at the top of the panel which also extends into the interior of the housing.

Furthermore, the preferred construction of the promotional/delivery system of this invention comprises a movable component which is preferably constructed as a substantially flat plate or panel dimensioned for being inserted in and fully retained within the housing forming the fixed component. In addition, the movable component incorporates a tab member formed along the bottom edge of the substantially flat plate/panel, with the tab being folded relative to the bottom edge for effectively extending away from the plate/panel.

In addition, the tab member is positioned along the bottom edge of the plate/panel for cooperating engagement with the ledge and the tab or finger of the panel mounted on the inside surface of the housing. In this way, as is more fully detailed below, when the plate/panel comprising the movable component is inserted into the housing forming the fixed component, the plate/panel becomes lockingly engaged with the ledge or interior panel formed inside the housing when in its first position and lockingly engaged with the tab/finger when in its second position.

In completing the construction of the promotional/delivery system of this invention, a biasing member, preferably in the form of a small leaf spring or wire, is mounted in the housing with one end thereof affixed to the housing and the opposed end thereof affixed to or controllably engaged with the plate/panel of the movable component. As a result, the lock interengagement of the tab member with the inwardly extending ledge of the panel of the housing causes the plate/panel of the movable component to remain securely hidden from view within the housing when the plate/panel is in its first position.

In addition, whenever the user activates the promotional/delivery system of the present invention, the plate/panel of the movable component is released from locked engagement with the housing, enabling the biasing member to move the plate/panel relative to the housing for extending outwardly from the housing until lockingly engaging the finger/tab of the housing. In this way, a completely unanticipated, surprising, interest generating, and exciting display is attained. Furthermore, by mounting a gift, promotional items, card, or other premium to the movable plate/panel, the user or recipient of the promotional/delivery system of the present invention is effectively presented with the desired gift or premium in an unanticipated, unique, and exciting manner.

In a preferred construction, the outer surfaces, or exposed surfaces, of the promotional and/or delivery system of the present invention incorporate preprinted information in order to communicate to the consumer the desired promotional message. This printed information typically comprises indicia, designs, logos, graphics, photographs, pictures, cutouts, or other types of visually stimulating displays which will promote interest and excitement to the user or recipient. Furthermore, the movable plate/panel incorporated into the promotional/delivery system also incorporates printed information, in addition to any gift, premium, award, certificate, prize, and the like which the manufacturer sponsor desires the user/recipient to receive. In this way, a desired promotional message is displayed in an easily manufactured product which is capable of delivering a unique, surprising, and unexpected popup effect which is completely controlled by the action of the consumer/user.

Although the present invention can be implemented using a wide variety of alternate sizes, shapes, configurations, and constructions, the preferred construction for the present invention employs two components, plus the biasing member with both components being constructed in a flat configuration which is easily assembled into the desired elements. In this regard, the housing member is preferably constructed from a single flat component which is folded to create the desired housing construction.

In achieving this easily constructed and assembled member, the front panel and rear panel are preferably interconnected to each other with a side edge mounted therebetween, while the opposed side extends outwardly from the front panel or rear panel. The bottom edge is formed by a separate component extending from the bottom edge of the front panel while the inwardly extending ledge or plate is formed as a further component mounted to the top edge of the front panel which is easily folded downwardly into overlying interengagement with the inside surface of the front panel, thereby establishing the inwardly extending ledge and tab/finger. By simply folding these elements in the desired manner, an easily constructed housing having the characteristics and construction details required for the present invention is easily achieved.

In addition, as discussed above, the plate/panel member forming the movable component is easily constructed from a substantially flat member having the desired size and shape, with the tab member extending from one edge thereof. By merely folding the tab member relative to the edge of the plate/panel, the movable component is easily constructed ready for assembly. By first securing one end of the biasing member in the housing and connecting the opposed end of the biasing member to the plate/panel, the fully completed assembly of the promotional/delivery system of this invention is quickly and easily realized.

If desired, the front panel of the housing may incorporate a cut out zone which is positioned in overlying relationship with the tab member of the plate/panel. Alternatively, visible instructions can be printed on the front panel of the housing for informing the user that activation of the promotional/delivery system of this invention is attained by pressing a specific location. Regardless of which embodiment is employed, the user activates the promotional/delivery system of this invention by pushing in the desired area, causing the tab member of the plate/panel to move inwardly, effectively dislodging the tab member from locked engagement with the ledge of the panel of the housing. Once the tab member is removed from locked engagement with the ledge, the biasing member is able to force the plate/panel member to slide relative to the housing for being immediately revealed, moving from its original hidden position to its fully exposed, display position.

In addition to employing the present invention for presenting the user or consumer with gifts, promotions, awards, displays, certificates, prizes or other premiums, the present invention may also incorporate any desired sound or light generating components for further enhancing the surprising presentation of the movable plate/panel member when the system is activated. In this way, added interest is generated, along with enhancing the unanticipated and surprising result produced by the present invention.

Furthermore, the plate/panel member can be constructed in a wide variety of unique configurations, such as incorporating movable parts or components integrally formed therewith, which become evident only upon movement of the plate/panel from its first stored position into its second exposed position. In this way, added interest and excitement is created with the user/consumer realizing enhanced enjoyment in the resulting surprise presentation of plate/panel member.

The invention accordingly comprises an article of manufacture possessing the features, properties, and relation of elements which will be exemplified in the article hereinafter described, and the scope of the invention will be indicated in the claims.

THE DRAWINGS

For a fuller understanding of the nature and objects of the invention, reference should be had the following detailed description taken in connection with the accompanying drawings, in which.

Figure 9:
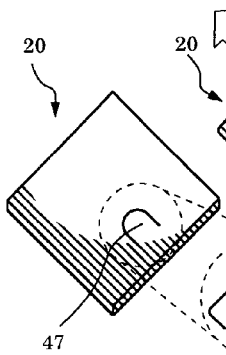
Figure 10:
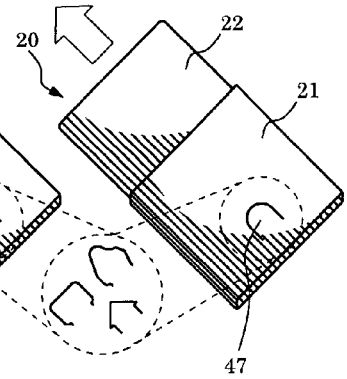

FIGS. 9 and 10 are perspective views of the promotional/delivery system of the present invention shown with alternate configurations for the activation zone; and FIGS. 11-26 are all perspective views of the promotional/delivery system of the present invention depicting the alternate constructions, configurations, and system embellishments which may be incorporated into the promotional/delivery system of the present invention.

DETAILED DISCLOSURE

By referring to FIGS. 1-26, along with the following detailed discussion, the construction and operation of alternate embodiments of the present invention can best be understood. Although this disclosure fully details these alternate embodiments, further alternate constructions and configurations can be employed to achieve the present invention. Consequently, it is to be understood that FIGS. 1-26, as well as the following detailed disclosure, are provided for exemplary purposes only and are not intended as a limitation of the present invention.

Figure 1:
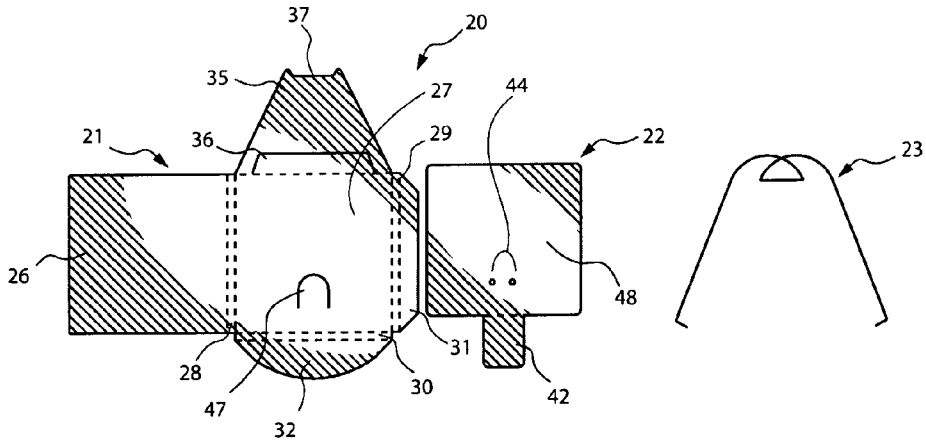
FIG. 1 is an exploded top plan view depicting each of the components of the promotional/delivery system of the present invention in a substantially planar, disassembled configuration.

In FIG. 1, promotional/delivery system 20 is depicted as comprising housing member 21, plate/panel member 22 and biasing member 23. By employing these components in the manner detailed herein, a unique, distinctive, eye-catching, interest generating, excitement producing promotional/delivery system is attained which can be employed for a wide variety of alternate purposes. Furthermore, as is evident from the following detailed discussion, promotional/delivery system 20 provides the user or consumer with an unexpected surprising display which further enhances the excitement and interest produced by system 20.

In the preferred embodiment, housing member 21 comprises a unitary construction which incorporates rear wall 26, front wall 27, side edges 28 and 29, and bottom edge 30. As depicted, side edge 28 is formed between front wall 27 and rear wall 26, preferably being interconnected therebetween. Furthermore, side edge 29 is formed by flange 31 which extends from the opposed side of front wall 27. Finally, bottom edge 30 is formed by flange 32 which is mounted to and extends from the bottom edge of front wall 27.

By employing this construction, housing 21 is able to be quickly and easily formed from a precut, substantially flat single component which is easily assembled by folding rear wall 26 relative to front wall 27, while also forming side edge 28. In addition, flanges 31 and 32 are folded inwardly, in order to form the edges of housing member 21. Thereafter, rear wall 26 is affixed to folded flanges 31 and 32, by employing suitable adhesive means.

The assembly of housing 21 is completed by employing interior panel member 35 and mounting interior panel member 35 in the desired position. As depicted in FIG. 1, panel member 35 is preferably mounted along the top edge of front wall 27 and constructed for being folded along this edge in order to enable panel member 35 to be placed in contact with the interior surface of front wall 27. Preferably, once panel member 35 is folded into the desired position, panel member 35 is affixed to the interior surface of front wall 27 by suitable adhesive means.

In order to provide the desired construction and operation being sought for the present invention, panel member 35 incorporates tab or finger 36 which is cut from member 35 and is constructed for extending inwardly towards the rear wall 26 once panel member 35 is mounted in place. In this way, as is detailed below, tab 36 provides a positive stop for limiting the movement of plate/panel member 22 and holding plate/panel member 22 in its second, extended position. Furthermore, as is more fully detailed below, member 35 also incorporates bottom edge 37 which is positioned, dimensioned, and constructed for forming a ledge which is cooperatively associated with plate/panel member 22 to hold plate/panel member 22 in its first retained position.

Once fully assembled, in the manner detailed above, housing 21 comprises an interior zone or cavity 40 which is defined by the inside surfaces of front wall 27, rear wall 26, side edges 28 and 29, and bottom edge 30. In addition, cavity 40 incorporates a single entry portal 41 which is formed along the top surface of housing 20. By employing entry portal 40, plate/panel member 22 is able to be easily moved between its first, stored position and its second, extended position.

As clearly shown in FIGS. 1-5, plate/panel member 22 is formed from a substantially flat, rectangular-shaped member 48 which is dimensioned for being easily movable in cavity 40 of housing 21. In addition, flat member 48 incorporates tab 42 extending from the lower edge thereof, which can be formed integrally with enlarged flat panel-forming member 48. However, prior to assembly, tab 42 is folded upwardly along the edge of member 48, for arcuately extending away from member 48. This construction is clearly depicted in FIGS. 2 and 3.

As shown, tab 42 is constructed, positioned, and dimensioned for contacting ledge 37 of panel member 35 when promotional/delivery system 20 is finally assembled. However, in order to provide the desired automatic movement of plate/panel member 22 in housing 21 when initiated by the user, biasing member 23 is installed in the desired position.

In the preferred construction, biasing member 23 comprises a leaf spring or wire spring which is mounted at one end thereof to mounting zone 43 formed on flange 32 of housing member 21. In addition, the opposed end of biasing member 23 is secured to mounting zone 44 of plate/panel member 22. Although mounting zone 43 and 44 may comprise a wide variety of alternate constructions, the use of apertures through which the terminating ends of biasing member 23 is preferably employed, as depicted.

Once biasing member 23 is mounted in the desired position, and tab 42 is arcuately pivoted relative to plate/panel member 22, the final assembly of promotional/delivery system 20 is easily achieved by advancing plate/panel member 22 through entry portal 41 of cavity 40, and into cavity 40 until tab 42 is placed in contact with ledge 37 of panel member 35. Once in this position, plate/panel member 22 is retained in the first, fully stored position, with the engagement between tab 42 and ledge 37 resisting the spring forces exerted on plate/panel member 22 by biasing member 23.

Figure 2:
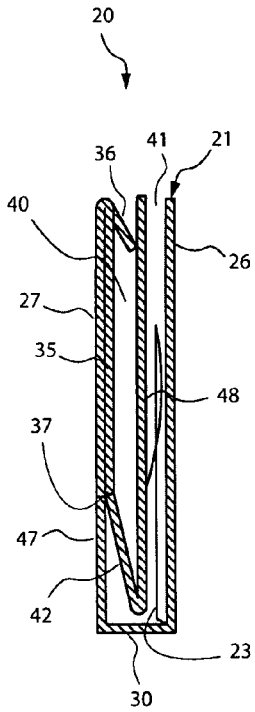
FIG. 2 is a cross-sectional, side elevation view depicting the promotional/delivery system of the present invention in its fully assembled and locked configuration.
Figure 4:
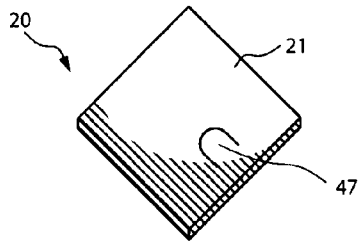
FIG. 4 is a perspective view depicting the fully assembled promotional/delivery system of the present invention in its locked position.

Once promotional/delivery system 20 is fully assembled, in the manner detailed above and shown in FIGS. 2 and 4, plate/panel member 22 remains stored in its first, hidden position within housing member 21 until the user activates plate/panel member 22. In order to achieve the desired movement, the user merely presses activation button 47 formed on front wall 27 of housing 21.

Although activation button 47 may comprise a wide variety of alternate constructions and configurations, as further discussed below, activation button 47 is depicted as a movable flap formed in front wall 27 by an inverted U-shaped cut. In this simple, straightforward manner, movable activation button 47 is created.

In addition, activation button 47 is positioned in alignment with tab 42 of plate/panel member 22. As a result, whenever activation button 47 is pressed, the flap-forming member moves inwardly, causing tab 47 to arcuately pivot towards plate/panel member 22. This movement causes tab 42 to be dislodged from engagement with ledge 37, enabling biasing member 23 to automatically move plate/panel member 22 upwardly in cavity 40 or housing 21. The movement of plate/panel member 22 continues due to the spring forces of biasing member 23 until tab 42 contacts tab 36 of panel member 35.

Figure 3:
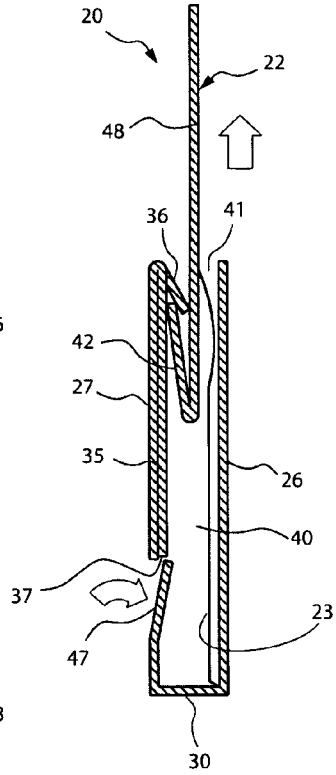
FIG. 3 is a cross-sectional, side elevation view depicting the promotional/delivery system of the present invention fully assembled and in its second, released position.
Figure 5:
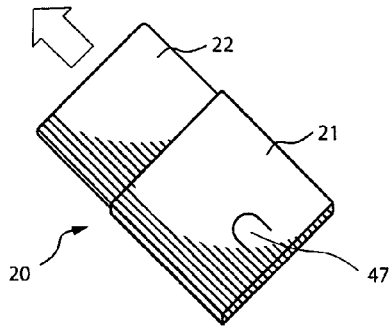
FIG. 5 is a perspective view depicting the fully assembled promotional/delivery system of the present invention in its second, released position.

The engagement of tab 42 with tab 36 prevents plate/panel member 22 from moving any further, causing plate/panel member 22 to be locked in its second, fully extended position, as depicted in FIGS. 3 and 5. Once in this position, plate/panel member 22 is fully displayed to the user, presenting the user with the printed indicia, card, gift, promotion, display, award, certificate, prize, premium, etc. desired by the manufacturer or sponsor to be presented to the user. In addition, as is evident from the foregoing detailed disclosure, promotional/delivery system 20 of the present invention provides a unique, exciting, and interest generating promotional vehicle which provides the consumer, recipient, or user with a desirable product or information in a manner which is both surprising and pleasurable.

In the preferred construction, the outer or exposed surfaces of the components forming promotional/delivery system 20 incorporate preprinted information in order to communicate to the consumer the desired promotional message. This printed information typically comprises indicia, designs, logos, graphics, photographs, pictures, cutouts, or other types of visually stimulating displays which will promote interest and excitement to the user or recipient. Furthermore, movable plate/panel 22 incorporated into promotional/display system 20 also incorporates similar printed information, in addition to any gift, premium, award, certificate, prize, and the like which the manufacturer sponsor desires the user/recipient to receive. In this way, a desired promotional message is displayed in an easily manufactured product which is capable of delivering a unique, surprising, and unexpected pop up effect which is completely controlled by the action of the consumer/user.

Figure 6:
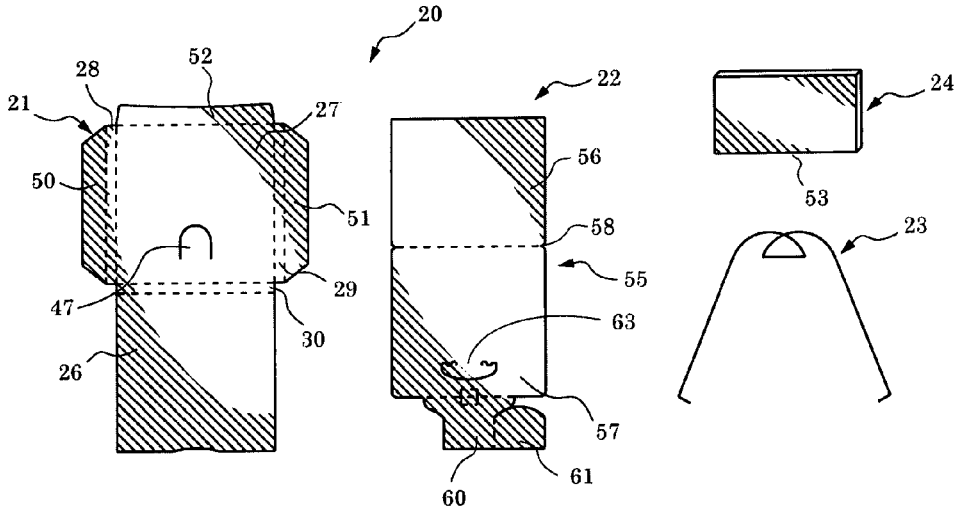
FIG. 6 is an exploded top plan view of an alternate embodiment of the promotional/delivery system of the present invention depicting each of the components of this alternate embodiment in a substantially planar, disassembled configuration.
Figure 7:
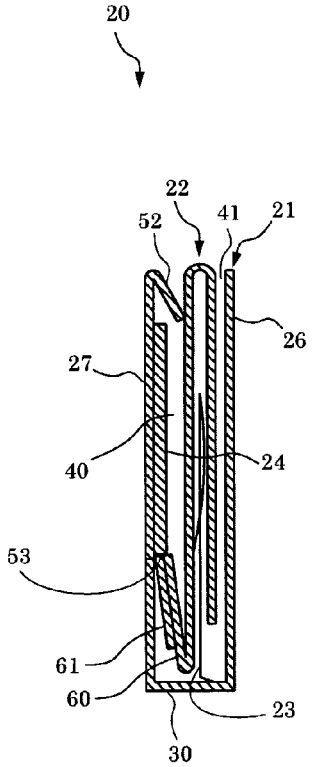
FIG. 7 is a cross-sectional, side elevation view depicting the promotional/delivery system of FIG. 6 in its fully assembled and locked configuration.
Figure 8:
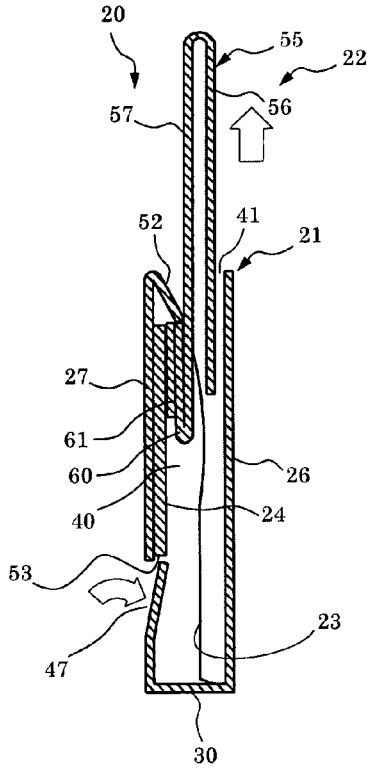
FIG. 8 is a cross-sectional, side elevation view depicting the promotional/delivery system of FIG. 6 in its fully assembled and second released position.

In FIGS. 6-8, an alternate embodiment of promotional/delivery system 20 is depicted. In this embodiment, system 20 comprises housing member 21, plate/panel member 22 and biasing member 23. In addition, a separate latching plate 24 is embodiment in this embodiment. By employing these components in the manner detailed herein, unique, distinctive, eye-catching, interest generating, excitement producing promotional/delivery system 20 is attained which can be employed for a wide variety of alternate purposes. Furthermore, as is evident from the following detailed discussion, promotional/delivery system 20 provides the user or consumer with an unexpected surprising display which further enhances the excitement and interest produced by system 20.

In the preferred construction of this embodiment, housing member 21 comprises a unitary construction which incorporates rear wall 26, front wall 27, side edges 28 and 29, and bottom edge 30. As depicted, bottom edge 30 is formed between front wall 27 and rear wall 26, preferably being interconnected therebetween. Furthermore, side edge 28 is formed by flange 50 which extends from one side of front wall 27, while side edge 29 is formed by flange 51 which extends from the opposed side of front wall 27. Finally, flap 52 is mounted to the top edge of front wall 27 and extends therefrom.

By employing this construction, housing 21 is able to be quickly and easily formed from a precut, substantially flat single component which is easily assembled by folding rear wall 26 relative to front wall 27, while also forming side edge 30. In addition, flanges 50 and 51 are folded inwardly, in order to form the edges of housing member 21. Also, flap 52 is folded inwardly towards front wall 27. Thereafter, rear wall 26 is affixed to folded flanges 50 and 51, by employing suitable adhesive means.

The assembly of housing 21 is completed by affixing latching plate 24 to the inside surface of front wall 27 in the desired position. As depicted in FIGS. 6-8, latching plate 24 is preferably mounted to the interior surface of front wall 27, directly below flap 52. Preferably, once latching plate 24 is placed in the desired position, latching plate 24 is affixed to the interior surface of front wall 27 by suitable adhesive means.

In order to provide the desired construction and operation being sought for the present invention, flap 52 is constructed for extending inwardly towards the rear wall 26, directly above latching plate 24. In this way, as is detailed below, flap 52 provides a positive stop for limiting the movement of plate/panel member 22 and holding plate/panel member 22 in its second, extended position. Furthermore, as is more fully detailed below, latching plate 24 also incorporates bottom edge 53 which is positioned, dimensioned, and constructed for forming a ledge which is cooperatively associated with plate/panel member 22 to hold plate/panel member 22 in its first retained position.

Once fully assembled, in the manner detailed above, housing 21 comprises an interior zone or cavity 40 which is defined by the inside surfaces of front wall 27, rear wall 26, side edges 28 and 29, and bottom edge 30. In addition, cavity 40 incorporates a single entry portal 41 which is formed along the top surface of housing 20. By employing entry portal 41, plate/panel member 22 is able to be easily moved between its first, stored position and its second, extended position.

As clearly shown in FIGS. 6-8, plate/panel member 22 is formed from a substantially flat, rectangular-shaped member 55 which comprises sections 56 and 57 cooperatively associated with each other for being folded along fold line 58. Once fully folded, member 55 is dimensioned for being easily movable in cavity 40 of housing 21. In addition, member 55 incorporates tabs 60 and 61, extending from the lower edge of section 57, with tabs 60 and 61 being constructed for folded, cooperating relationship with each other. Prior to assembly, tabs 60 and 61 are folded upwardly along the edge of section 57, for extending away from section 57. This construction is clearly depicted in FIGS. 7 and 8

As shown, tabs 60 and 61 are constructed, positioned, and dimensioned for contacting latching plate 24 when promotional/delivery system 20 is finally assembled. However, in order to provide the desired automatic movement of plate/panel member 22 in housing 21 when initiated by the user, biasing member 23 is installed in the desired position.

In the preferred construction, biasing member 23 comprises a leaf spring or wire spring which is mounted at one end thereof to a mounting zone formed on bottom edge 30 of housing member 21. In addition, the opposed end of biasing member 23 is secured to mounting zone 63 of section 57.

Once biasing member 23 is mounted in the desired position, and tabs 60 and 61 are arcuately pivoted relative to plate/panel member 22, the final assembly of promotional/delivery system 20 is easily achieved by advancing plate/panel member 22 through entry portal 41 of cavity 40, and into cavity 40 until tabs 60 and 61 are placed in contact with bottom edge 53 of plate 24. Once in this position, plate/panel member 22 is retained in its first, fully stored position, with the engagement between tabs 60 and 61 and edge 53 resisting the spring forces exerted on plate/panel member 22 by biasing member 23.

Once promotional/delivery system 20 is fully assembled, in the manner detailed above and shown in FIG. 7, plate/panel member 22 remains stored in its first, hidden position within housing member 21 until the user activates plate/panel member 22. In order to achieve the desired movement, the user merely presses activation button 47 formed on front wall 27 of housing 21.

Although activation button 47 may comprise a wide variety of alternate constructions and configurations, as further discussed below, activation button 47 is depicted as a movable flap formed in front wall 27 by an inverted U-shaped cut. In this simple, straightforward manner, movable activation button 47 is created.

In addition, activation button 47 is positioned in alignment with tabs 60 and 61 of plate/panel member 22. As a result, whenever activation button 47 is pressed, the flap-forming member moves inwardly, causing tabs 60 and 61 to arcuately pivot towards plate/panel member 22. This movement causes tabs 60 and 61 to be dislodged from engagement with edge 53, enabling biasing member 23 to automatically move plate/panel member 22 upwardly in cavity 40 of housing 21. The movement of plate/panel member 22 continues due to the spring forces of biasing member 23 until tabs 60 and 61 contact flap 52.

The engagement of tabs 60 and 61 with flap 52 prevents plate/panel member 22 from moving any further, causing plate/panel member 22 to be locked in its second, fully extended position, as depicted in FIG. 8. Once in this position, plate/panel member 22 is fully displayed to the user, presenting the user with the printed indicia, card, gift, promotion, display, award, certificate, prize, premium, etc. desired by the manufacturer or sponsor to be presented to the user. In addition, as is evident from the foregoing detailed disclosure, promotional/delivery system 20 of the present invention provides a unique, exciting, and interest generating promotional vehicle which provides the consumer, recipient, or user with a desirable product or information in a manner which is both surprising and pleasurable.

In the preferred construction, the outer or exposed surfaces of the components forming promotional/delivery system 20 incorporate preprinted information in order to communicate to the consumer the desired promotional message. This printed information typically comprises indicia, designs, logos, graphics, photographs, pictures, cutouts, or other types of visually stimulating displays which will promote interest and excitement to the user or recipient. Furthermore, movable plate/panel 22 incorporated into promotional/display system 20 also incorporates similar printed information, in addition to any gift, premium, award, certificate, prize, and the like which the manufacturer sponsor desires the user/recipient to receive. In this way, a desired promotional message is displayed in an easily manufactured product which is capable of delivering a unique, surprising, and unexpected pop up effect which is completely controlled by the action of the consumer/user.

As discussed above, activation button 47 may comprise any desired shape or configuration. As shown in FIGS. 9 and 10, various alternate configurations are depicted including rectangles, arrow heads, circles, curved configurations, and the like. Furthermore, if desired, the activation area can be designated by merely printing indicia on front wall 27, for enabling the user to merely press the front wall in its entirety a sufficient distance which will cause tab 42 to become dislodged from ledge 37 or edge 53. However, regardless of the configuration or structure employed, the activation of plate/panel member 22 is achieved.

In order to provide further excitement, interest, enhancements, and surprising results from the use of promotional/delivery system 20, housing 21 and/or plate/panel member 22 can incorporate a wide variety of alternate configurations, constructions, and interest generating enhancements. In order to exemplify the variety of constructions that can be employed in the present invention, without departing from the scope of this invention, alternate constructions and configurations are depicted in FIGS. 11-26. It is to be understood, however, that these alternate embodiments are provided as examples of the numerous constructions and configurations and enhancements that can be employed in the present invention, without limiting the scope of the present invention.

Figure 11:
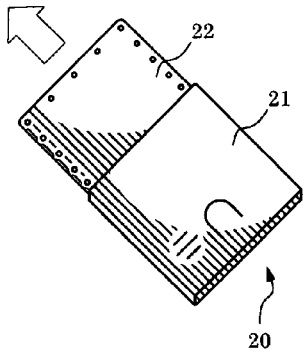

In FIG. 11, housing 21 and plated/panel member 22 are depicted incorporating sound generating means and/or light generating means for producing visual and/or audible complementary effects. In this regard, the sound and light means incorporated into promotion/delivery system 20 is preferably activated simultaneously with the activation of plate/panel member 22 from its stored position to its fully extended position. However, any other activation systems can be employed with equal efficacy.

Figure 12:
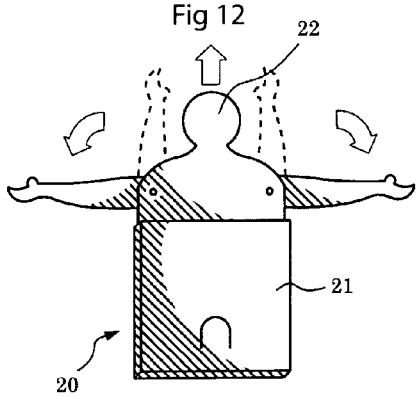

In FIG. 12, a further alternate embodiment of promotional/delivery system 20 of the present invention is depicted. In this embodiment, housing member 21 incorporates a movable plate/panel member 22 which is constructed with portions thereof being movable relative to other portions. In the embodiment depicted, plate/panel member 22 comprises an overall construction representative of a person's body, with the arms of the individual arcuately pivotable relative to the body. By employing this construction, plate/panel member 22 emerges from housing member 21 with the arms of the body being able to arcuately pivot in response to movement of plate/panel member 22 from the stowed position to the fully displayed position. Furthermore, as is evident to one having ordinary skill in the art, a wide variety of alternate constructions, configurations, and graphical representations can be employed with movable components formed therein which would employ this concept.

Figure 13:
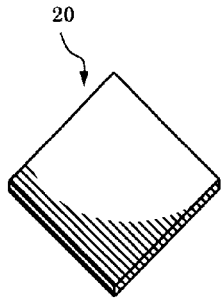
Figure 14:
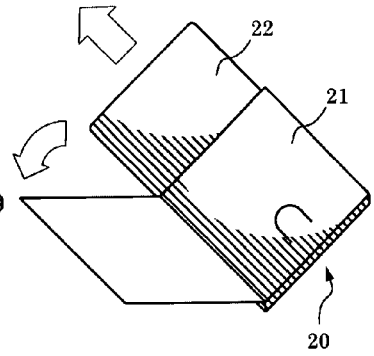

In FIGS. 13 and 14, promotional/delivery system 20 is shown incorporating a movable cover cooperatively associated with housing 21. In this way, added visual indicia, information, messages, logos, colors, and the like can be printed thereon for adding additional interest and excitement. Furthermore, if desired, the movable cover may also be interconnected with plate/panel member 22 in order to cause plate/panel member 22 to move from its first stowed position to its second fully displayed position in response to the arcuate pivoting movement of the cover.

Figure 15:
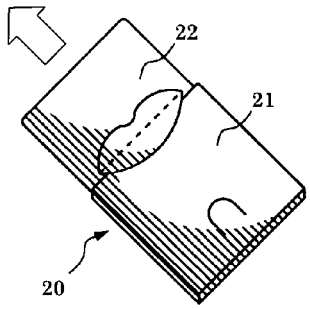

In FIG. 15, a further alternate variation is depicted wherein promotional/delivery system 20 incorporates a three dimensional, pop-up element formed between housing 21 and plate/panel member 22. In this embodiment, the three-dimensional, pop-up element is preferably activated simultaneously with the activation of plate/panel member 22 from its first, stowed position to its second, fully displayed position.

Figure 16:
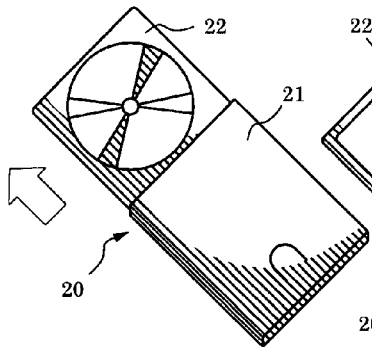
Figure 17:
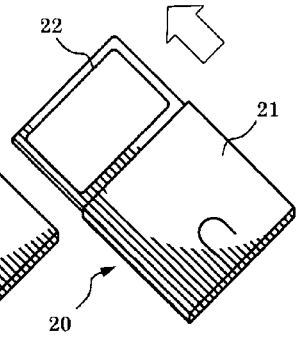

In FIGS. 16 and 17, further alternate embodiments are depicted wherein plate/panel member 22 incorporates a holding zone for holding or retaining additional prizes, awards, gifts, promotional items, and the like. In FIG. 16, plate/panel member 22 is depicted holding a compact disc or DVD, while FIG. 17 depicts plate/panel member 22 incorporating a holding zone for items such as business cards, credit cards, and the like.

Figure 18:
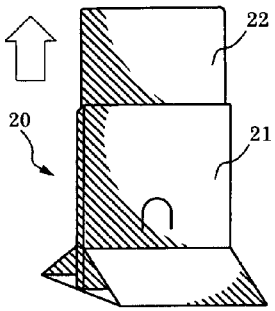

In FIG. 18, promotional/delivery system 20 is depicted mounted to a supporting member for enabling promotional/delivery system 20 to be displayed in a substantially vertical orientation. In this embodiment, housing member 21 is preferably secured to the support member, for enabling plate/panel member 22 to be easily moved between its first stowed position and its second display position.

Figure 19:
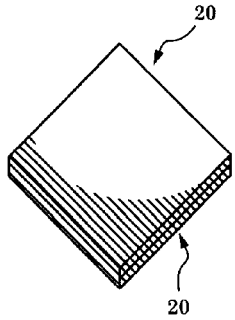
Figure 20:
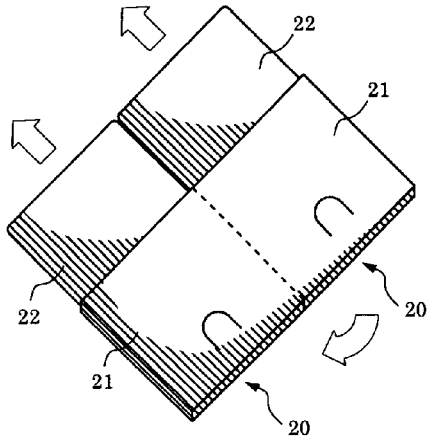

In FIGS. 19 and 20, a still further alternate embodiment of the present invention is depicted. In this embodiment, two separate and independent promotional/delivery systems 20 are mounted to each other along one side edge in a general book form, for enabling the two promotional/delivery systems 20 to be folded and unfolded relative to each other. In this way, the two cooperating promotional/delivery systems 20 can be unfolded from a general book configuration for enabling the two separate and independent plate/panel members 22 to be activated whenever desired by the user.

Figure 21:
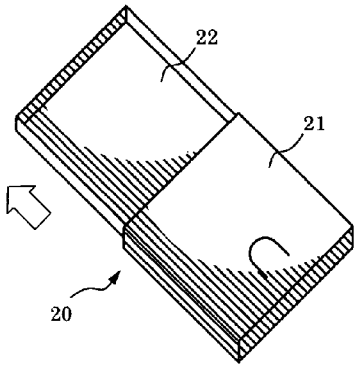

In FIG. 21, a still further alternate construction of the present invention is shown, wherein promotional/delivery system 20 incorporates a plate/panel member 22 which is constructed as a drawer incorporating sidewalls for enabling any desired premium, promotion, gifts, etc. to be retained therein. In this way, whenever the user wishes to activate and received the items contained in plate/panel member 22, housing 21 is activated, in the normal manner, thereby enabling access to plate/panel member 22 to be easily achieved.

Figure 22:
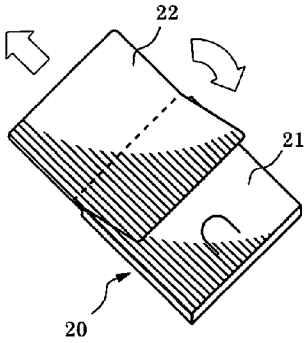

In FIG. 22, a further alternate construction of the present invention is shown wherein plate/panel member 22 incorporates a movable panel integrally form therewith which is activated simultaneously with the activation of plate/panel member 22. In this way, whenever desired by the user, housing 21 is activated causing plate/panel member 22 to move into its second, fully displayed position which simultaneously causes the folding panel to be simultaneously displayed.

Figure 23:
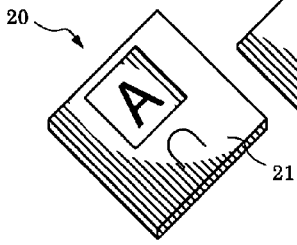
Figure 24:
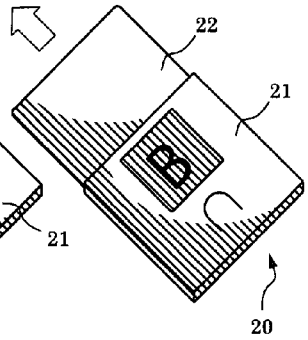

In FIGS. 23 and 24, housing 21 of promotional/delivery system 20 incorporates a cut-out zone having indicia displayed therein. In addition, the cut-out zone of housing 21 is constructed for cooperating with an indicia changing system incorporated in plate/panel member 22 for causing the indicia displayed through the cut-out zone to be changed simultaneously with the activation of plate/panel member 22. In this way, added interest, excitement, and surprising effects are achieved.

Figure 25:
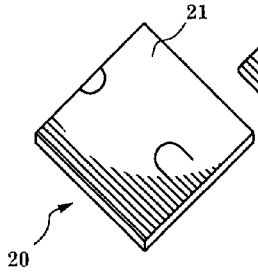
Figure 26:
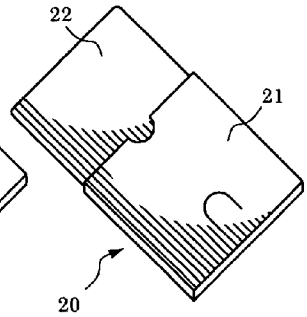

Finally, in FIGS. 25 and 26, a still further alternate construction of promotional/delivery system 20 is depicted. In this embodiment, housing 21 incorporates a manual pull tab or cut-out zone formed therein for enabling the user to directly access plate/panel member 22 when in its first, stowed position. In this way, if the activation button is not functioning properly or if an alternate access is desired, the pull tab or cut-out zone can be employed for assuring the user is able to cause plate/panel member 22 to be moved into its second, fully displayed position.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. An advertising/promotional display/gift system constructed for being responsive to user activation and comprising:

A. a housing comprising a front wall and a rear wall mounted in juxtaposed, spaced relationship with each other and defining an internal cavity therebetween;

B. a panel member
   a. mounted in the internal cavity of the housing, and
   b. being movable between a first, fully stowed position and a second, display position;

C. movement control means comprising
   a. a biasing member mounted in the cavity and interconnected with the panel member and with one wall of the housing for causing the movement of the panel member relative to the housing,
   b. a latch engaging member mounted to the panel member extending outwardly therefrom and positioned for engaging a first latching tab and a second latching tab,
   c. said first latching tab formed on one wall of the housing and positioned for engaging the latch engaging member of the panel for holding the panel in its first stowed position, and
   d. said second latching tab formed on one wall of the housing and positioned for engaging the latch engaging member of the panel for holding the panel in its second display position;

whereby an advertising/promotional display/gift system is achieved which is easily constructed and employed by the user for providing both interest and excitement.

2. The advertising/promotional display/gift system defined in claim 1, wherein said housing is further defined as comprising at least one open end formed between terminating edges of the front wall and the rear wall for enabling the panel member to extend outwardly from the housing when in its second display position.

3. The advertising/promotional display/gift system defined in claim 2, wherein the first latching tab and the second latching tab are further defined as being mounted on the inside surface of the front wall of the housing in vertically aligned relationship with each other.

4. The advertising/promotional display/gift system defined in claim 3, wherein said second latching tab comprises a folded flap formed along the top edge of the front wall of the housing and extending inwardly therefrom into the internal cavity.

5. The advertising/promotional display/gift system defined in claim 4, wherein the first latching tab comprises the bottom edge of a plate mounted to the inside surface of the front wall of the housing in spaced relationship below the second latching tab.

6. The advertising/promotional display/gift system defined in claim 5, wherein said plate is further defined as comprising one selected from the group consisting of a separate and independent plate affixed to the inside surface of the front wall of the housing and a folded plate member integrally attached to the front wall of the housing and folded onto the inside surface thereof.

7. The advertising/promotional display/gift system defined in claim 6, wherein said latch engaging member is further defined as comprising at least one folded section extending from the panel member and positioned for cooperative association with the first and second latching tabs.

8. The advertising/promotional display/gift system defined in claim 1, wherein said system further comprises an activation zone formed on the front wall of the housing and positioned for disengaging the latch engaging member of the panel member from engagement with the first latching tab.

9. The advertising/promotional display/gift system defined in claim 8, wherein said activation zone comprises a cut-out area formed in the front wall for enabling ease of movement.

10. The advertising/promotional display/gift system defined in claim 1, wherein said biasing means is further defined as comprising an elongated, coil spring member mounted to one wall of the housing at one end thereof and to the panel member at the opposed end thereof with said coil spring member being constructed for exerting a continuously biasing force on the panel member when said panel member is in its first position, while also causing the panel member to move into its second position whenever the first locking tab has been disengaged from the latch engaging member.

11. The advertising/promotional display/gift system defined in claim 1, wherein said panel member is further defined as comprising one selected from the group consisting of a single flat plate member, a two piece plate member folded into two overlying sections, and a multi-segmented plate member having separately articulatable sections formed therein.

12. The advertising/promotional display/gift system defined in claim 1, wherein said housing is further defined as comprising three closed side edges formed between the front wall and the rear wall.

13. The advertising/promotional display/gift system defined in claim 1, wherein said system is further defined as incorporating one or more selected from the group consisting of visual display elements and audible display elements.

14. The advertising/promotional display/gift system defined in claim 1, wherein said panel member is further defined as comprising a holding zone for securely and secretly retaining one or more selected from the group consisting of prizes, gifts, awards, CDs, DVDs, credit cards, business cards, and promotional information.

15. The advertising/promotional display/gift system defined in claim 1, wherein said housing is further defined as being cooperatively associated with a support member for enabling the advertising/promotional display/gift system to be supported in a substantially vertical position.

16. The advertising/promotional display/gift system defined in claim 1, wherein a plurality of separate and independent advertising/promotional display/gift systems are cooperatively mounted to each other in a substantially stacked array for enabling each of said systems to be arcuately pivoted relative to the other in its entirety for separate or simultaneous use.

17. The advertising/promotional display/gift system defined in claim 1, wherein said advertising/promotional display/gift system incorporates a manual control member for assuring the movement of the panel member relative to the housing.

18. The advertising/promotional display/gift system defined in claim 1 wherein said system further comprises changeable graphic elements formed thereon for providing additional interest, excitement, and visual distinction to the present invention.

* * * * *